US007319450B2

(12) United States Patent
Choi

(10) Patent No.: US 7,319,450 B2
(45) Date of Patent: Jan. 15, 2008

(54) METHOD AND APPARATUS FOR DRIVING A THIN FILM TRANSISTOR LIQUID CRYSTAL DISPLAY

(75) Inventor: Chang-Hwe Choi, Suwon (KR)

(73) Assignee: Samsung Electronics Co., Ltd, Gyeonggi-do (KR)

( * ) Notice: Subject to any disclaimer, the term of this patent is extended or adjusted under 35 U.S.C. 154(b) by 439 days.

(21) Appl. No.: 10/640,245

(22) Filed: Aug. 14, 2003

(65) Prior Publication Data

US 2004/0108988 A1 Jun. 10, 2004

(30) Foreign Application Priority Data

Dec. 5, 2002 (KR) ..... 10-2002-0077032

(51) Int. Cl.
*G09G 3/36* (2006.01)
*G09G 5/00* (2006.01)

(52) U.S. Cl. ..... 345/92; 345/87; 345/89; 345/100; 345/213

(58) Field of Classification Search ..... 345/89, 345/90, 92, 87, 213
See application file for complete search history.

(56) References Cited

U.S. PATENT DOCUMENTS 6,388,653 B1 * 5/2002 Goto et al. ..... 345/98
6,870,524 B2 * 3/2005 Katsutani ..... 345/98

FOREIGN PATENT DOCUMENTS

KR 1019990065059 12/1999
KR 2002-025791 4/2002

OTHER PUBLICATIONS

Korean Office Action dated Jan. 24, 2005, with English translation.

* cited by examiner

*Primary Examiner*—Richard Hjerpe
*Assistant Examiner*—My-Chau T. Tran
(74) *Attorney, Agent, or Firm*—Harness, Dickey & Pierce, PLC

(57) ABSTRACT

A method and apparatus is described that may be capable of improving picture quality of a TFT-LCD device, to prevent occurrence of a stripe phenomenon caused by an offset, i.e., differences among the voltages output from a plurality of amplifiers in a TFT-LCD source driver circuit. The method and apparatus may eliminate differences among voltages output from a plurality of amplifiers in a circuit such as a TFT-LCD source driver circuit. In the method, a panel driving voltage may be applied to a given pixel of a liquid crystal panel in response to a clock signal. The polarity of the applied panel driving voltage may be changed in response to a polarity control signal, and a switch control signal may be generated based on the polarity control signal. The switch control signal may be applied to switch first and second input ports of each of the plurality of amplifiers.

30 Claims, 8 Drawing Sheets

FIG. 9

| FRAME \ LINE | 1 | 2 | 3 | 4 | 5 |
|---|---|---|---|---|---|
| 1 | L | L | H | H | L |
| 2 | L | H | H | L | L |
| 3 | H | H | L | L | H |
| 4 | H | L | L | H | H |

METHOD AND APPARATUS FOR DRIVING A THIN FILM TRANSISTOR LIQUID CRYSTAL DISPLAY

PRIORITY STATEMENT

This application claims the priority of Korean Patent Application No. 2002-77032, filed on Dec. 5, 2002, in the Korean Intellectual Property Office, the disclosure of which is incorporated herein in its entirety by reference.

BACKGROUND OF THE INVENTION

1. Field of the Invention

The present invention relates to a thin film transistor (TFT)-liquid crystal display (LCD) panel driving circuit capable of preventing stripes from occurring on a TFT-LCD panel.

2. Description of the Related Art

TFT-LCD display devices are widely used in laptops and computer monitors. Circuits for driving TFT-LCD panels may be generally divided into gate driver circuits and source driver circuits.

FIG. 1 is a circuit diagram of a prior art TFT-LCD device. Referring to FIG. 1, a typical TFT-LCD device 100 includes a liquid crystal panel 105, a source driver circuit 110, and a gate driver circuit 120.

Each pixel 150 of the liquid crystal panel 105 is comprised of a liquid crystal capacitor C1 and a switch T1. The number of pixels 150 in a row direction of the liquid crystal panel 105 is equal to a given number (L) of source lines, and the number of pixels 150 in a column direction of the liquid crystal panel 105 is equal to a given number (M) of gate lines.

In each pixel 150, one terminal of a liquid crystal capacitor C1 is connected to a switch T1. The switch T1 is configured as a metal oxide semiconductor (MOS) transistor, and the gate of the switch T1 is connected to a gate line 140 extending from the gate driver circuit 120. The gate driver circuit 120 turns switch T1 on and off in each of the pixels 150.

The source driver circuit 110 inputs a grey scale voltage to the liquid crystal panel 105 via a source line 130. The amount of the input grey scale voltage depends on input data. In other words, when switches connected to the gate line 140 are turned on by an output voltage of the gate driver circuit 120, a grey scale voltage output from the source driver 110 is applied to liquid crystal capacitors C1 connected to the switches.

The source driver circuit 110 includes a plurality of amplifiers (not shown) arranged at an output port. Since a random direct current (DC) offset exists in each of the amplifiers, the output voltages from each of the amplifiers are different, even when a grey scale voltage for the same input data has been selected and applied to the amplifiers.

This difference between output voltages output from the respective amplifiers of the source driver circuit 110 may cause a 'stripe phenomenon' on an LCD screen or display. The stripe phenomenon results in degradation scale in the quality of picture images displayed on the LCD screen.

A method for removing DC offsets in the amplifiers of the source driver circuit 110 has been disclosed in U.S. Pat. No. 6,331,846. The method in the '846 patent describes a prior art chopping process for averaging DC offsets by switching input ports of amplifiers.

The prior art chopping process of the '846 patent is described in the following paragraphs with reference to FIG. 2, which is a diagram illustrating a method of driving a pixel by alternately applying a positive polarity voltage and a negative polarity voltage to frames of a single pixel. Each liquid crystal pixel may be described in terms of one or more frames, i.e., a single pixel may include a plurality of frames. Here, a positive polarity voltage is a voltage greater than a common voltage (Vc in FIG. 1) applied to a liquid crystal panel by a source driver. A negative polarity voltage is a voltage smaller than the common voltage applied to the liquid crystal panel by the source driver. In order to extend the life span of a liquid crystal panel, driving voltages having opposite polarities are applied to liquid crystal pixels.

Referring to FIG. 2, in a first frame, even though a positive polarity voltage 211 is supposed to be output, a voltage of 212 is actually output, due to the existence of an offset voltage (hereafter 'offset') of +A. Likewise, in a second frame, even though a negative polarity voltage of 221 is supposed to be output, a voltage of 222 is actually output due to the existence of an offset +B. In order to cancel the offset +A, it is necessary to apply a positive polarity voltage in a third frame having an offset −A. In order to cancel the offset +B, it is necessary to apply a negative polarity voltage in a fourth frame having an offset −B.

However, a driving circuit taught by the '846 patent implements a chopping process by counting a clock signal activated on each gate line, so that a DC offset can increase or decrease in each frame. However, the frequency of a clock signal varies, depending on the resolution of a liquid crystal panel, and a clock signal is generated in a blanking period between an end point of one frame and a start point of a following frame, i.e., between two adjacent frames.

Accordingly, in the prior art liquid crystal display panel having a specific resolution, where offsets in voltages output from amplifiers of a source driver circuit are controlled by the frequency of a clock signal, i.e., how frequently a clock signal is activated, DC offsets in output voltages may accumulate rather than cancel each other out. In such a case, the stripe phenomenon is more likely to occur on an LCD screen.

FIGS. 3A and 3B are diagrams illustrating canceling and accumulation of DC offsets when driving a liquid crystal display panel using a conventional source driver circuit. FIG. 3A shows two different cases using the same number of gate lines of a liquid crystal display panel, but having different numbers of clock signals (CLK1) generated during a blanking period. In FIG. 3A, (1) illustrates that a DC offset in a first frame cancels out a DC offset in a second frame, and (2) shows that DC offsets in the first and second frames are accumulated.

FIG. 3B also shows two different cases having different numbers of liquid crystal display panel gate lines, i.e., different resolutions. In FIG. 3B, (1) illustrates that a DC offset in a first frame cancels out a DC offset in a second frame, and (2) shows that DC offsets in the first and second frames accumulate rather than cancel each other out.

As described above, since resolution of a prior art liquid crystal display panel or the frequency of occurrence of a clock signal during a blanking period in the LCD panel varies, DC offsets of a panel driving voltage applied to a pixel may accumulate rather than cancel each other out. Thus, the quality of picture images displayed on an LCD screen may deteriorate.

SUMMARY OF THE INVENTION

An exemplary embodiment of the present invention is directed to a source driver integrated circuit for driving a thin film transistor liquid crystal display (TFT-LCD). The source driver integrated circuit may include an output driver that outputs a panel driving voltage to drive pixels of a liquid crystal panel in response to a clock signal. The output driver may further include a decoder that selects and outputs a grey scale voltage corresponding to an input digital signal; and an output amplifier that amplifies the grey scale voltage output from the decoder and outputs the result of the amplification as the panel driving voltage. The output amplifier may include a first input port receiving the output signal from the decoder, and a second input port electrically connected to an output port of the output amplifier. The first and second input ports may be switched in response to a given switch control signal. A control module in the source driver integrated circuit generates the switch control signal in response to the clock signal and a given polarity control signal.

Another exemplary embodiment of the present invention is directed to a circuit for driving a TFT-LCD, in which a decoder selects and outputs a positive voltage or a negative voltage in response to an input digital signal. At least first and second amplifiers amplify and output the positive and negative voltages, respectively, in response to the clock signal. Each of the first and second amplifiers may include a pair of input ports that are switched in response to a given switch control signal. The circuit further includes at least one switch that switches and applies output voltages of the first and second amplifiers to a liquid crystal panel in response to a polarity control signal. A control module generates the switch control signal in response to the clock signal and the polarity control signal.

Another exemplary embodiment of the present invention is directed to a method of eliminating offsets of driving voltage in a TFT-LCD. The TFT-LCD may include a plurality of amplifiers, each amplifier having first and second input ports and generating a panel driving voltage of a positive or negative polarity corresponding to a input digital signal. In the method, a panel driving voltage is applied to a given pixel of a liquid crystal panel in response to a clock signal. The polarity of the applied panel driving voltage may be changed in response to a polarity control signal. A switch control signal, synchronized to the clock signal, may be generated to switch the first and second input ports of each of the plurality of amplifiers.

Another exemplary embodiment of the present invention is directed to a method of driving voltage in a TFT-LCD that includes a plurality of amplifiers, each amplifier having at least first and second input ports. In the method, a panel driving voltage is applied to a given pixel of a liquid crystal panel in response to a clock signal. The polarity of the applied panel driving voltage may be changed in response to a polarity control signal, and a switch control signal may be generated based on the polarity control signal. The switch control signal may be applied to switch the first and second input ports of each of the plurality of amplifiers.

Another exemplary embodiment of the present invention is directed to an apparatus for driving a TFT-LCD. The apparatus may include an output driver outputting a panel driving voltage to drive pixels of a liquid crystal panel in response to an input clock signal. The output driver may further include a plurality of amplifiers, each amplifier having first and second input ports and generating a panel driving voltage of a positive or negative polarity corresponding to a input digital signal. A control module in the apparatus generates a switch control signal in response to the clock signal and an input polarity control signal. The switch control signal may be applied so as to switch the input ports in each of the amplifiers.

BRIEF DESCRIPTION OF THE DRAWINGS

The above features and advantages of the present invention will become more apparent by describing in detail exemplary embodiments thereof with reference to the attached drawings in which:

FIG. 9 is a table showing different states of the switch control signal of FIG. 8.

DETAILED DESCRIPTION OF THE EXEMPLARY EMBODIMENTS

Figure 1:
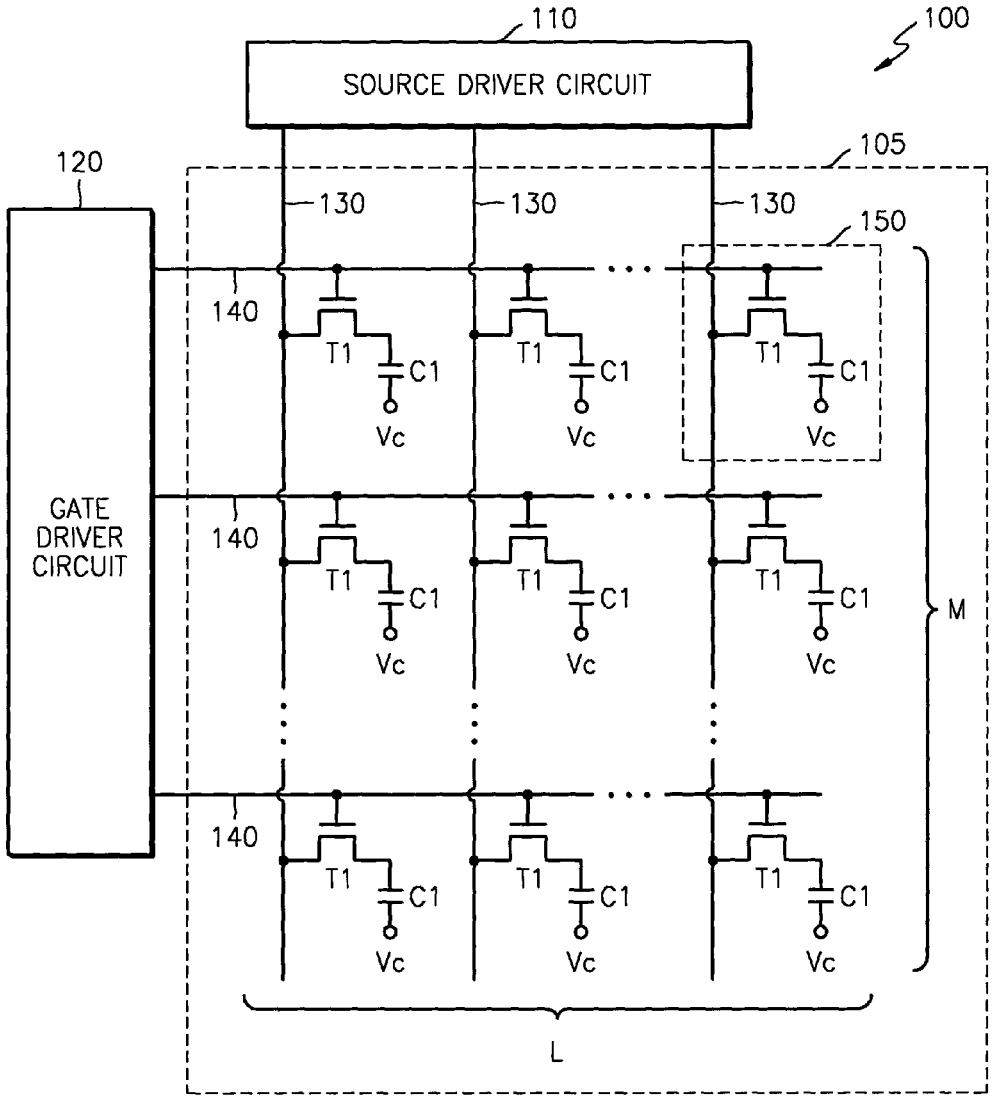
FIG. 1 (PRIOR ART)
FIG. 1 is circuit diagram of a prior art TFT-LCD device.
Figure 2:
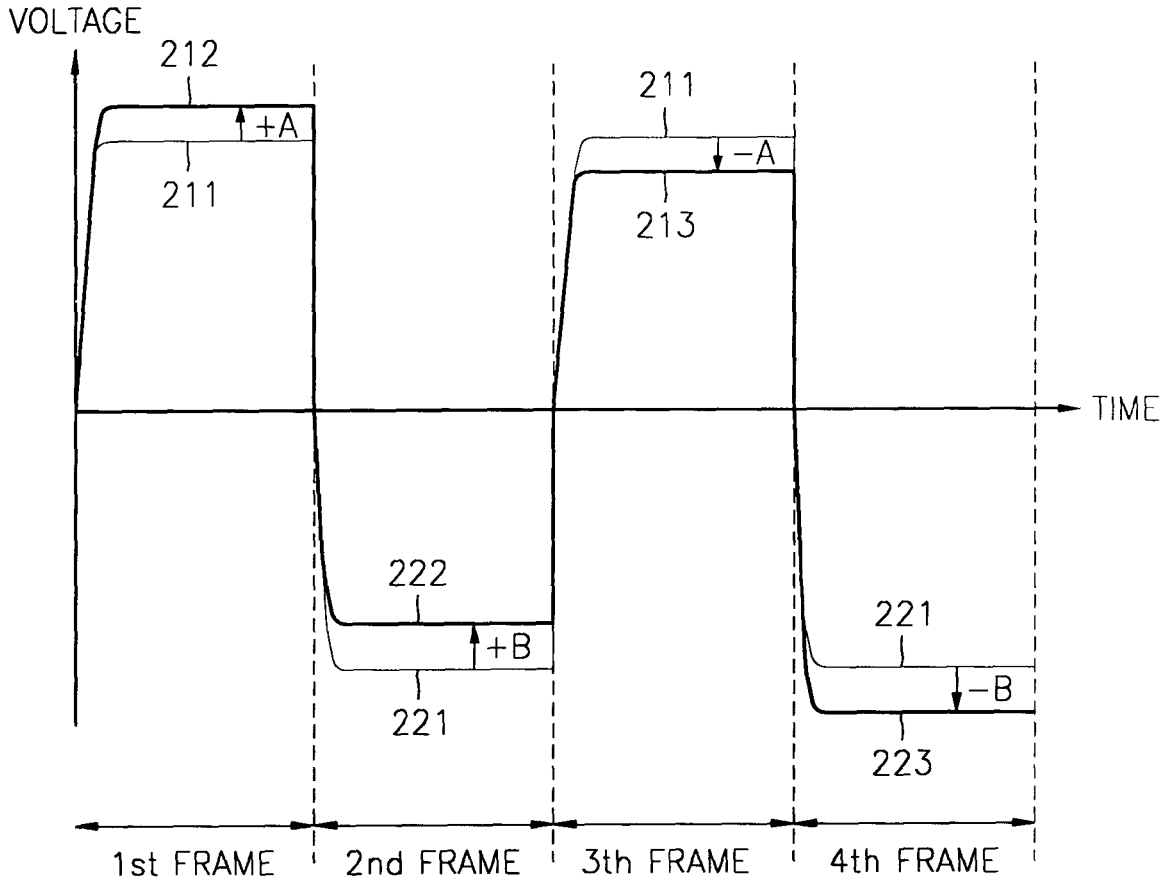
FIG. 2 (PRIOR ART)
FIG. 2 is a diagram illustrating a prior art chopping process.
Figure 3A:
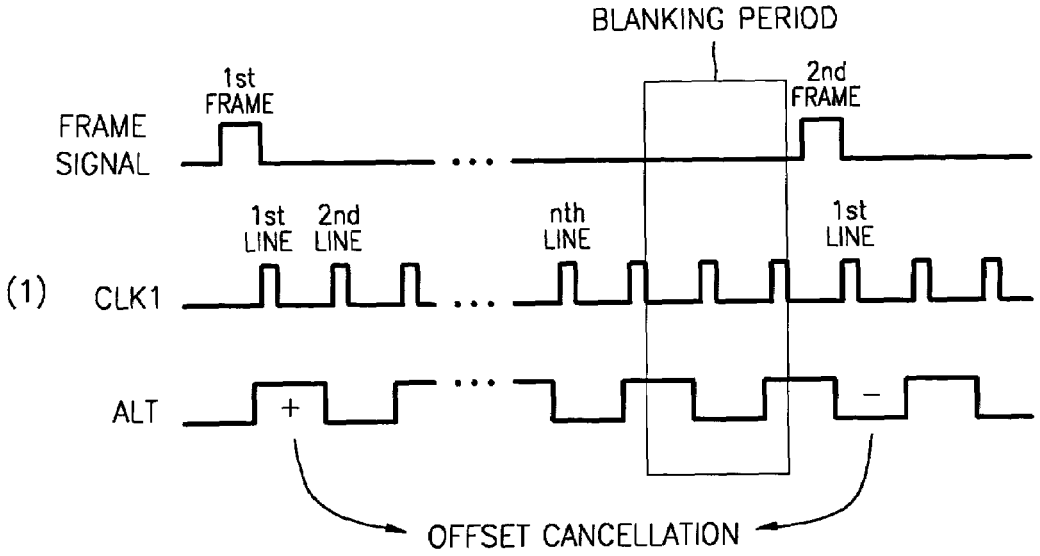
FIG. 3A (CONVENTIONAL ART)
FIGS. 3A and 3B are diagrams illustrating canceling and accumulation of DC offsets when driving a liquid crystal panel using a conventional source driver circuit.
Figure 3A:
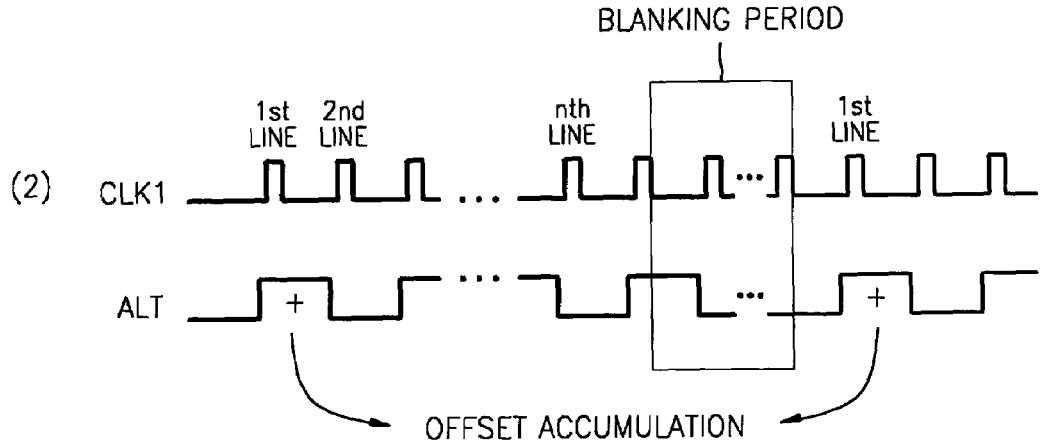
FIG. 3A (CONVENTIONAL ART)
Figure 3B:
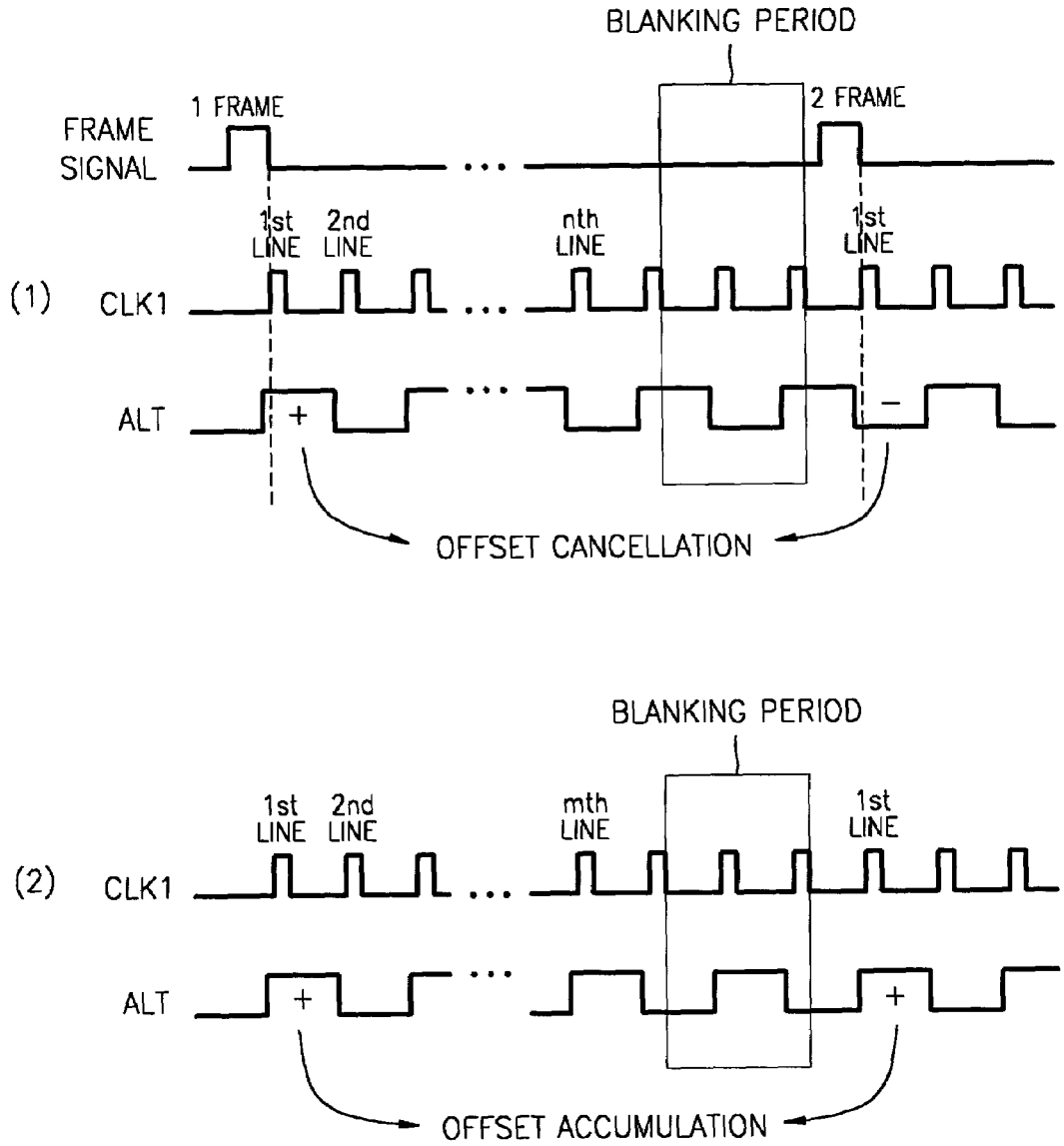
FIG. 3B (CONVENTIONAL ART)

Hereinafter, exemplary embodiments of the present invention will be described in greater detail with reference to the accompanying drawings, in which preferred embodiments of the invention are shown. The same reference numerals in different drawings represent the same elements.

The exemplary embodiments of the present invention are directed to an TFT-LCD source driver circuit capable of improving picture quality of a TFT-LCD device by preventing a stripe phenomenon caused by an offset, i.e., differences among the voltages output from a plurality of amplifiers in the TFT-LCD source driver circuit. Additionally, exemplary embodiments of the present invention are directed to a method of driving voltage so as to eliminate differences among voltages output from a plurality of amplifiers in an apparatus or circuit such as a TFT-LCD source driver circuit, for example.

Figure 4:
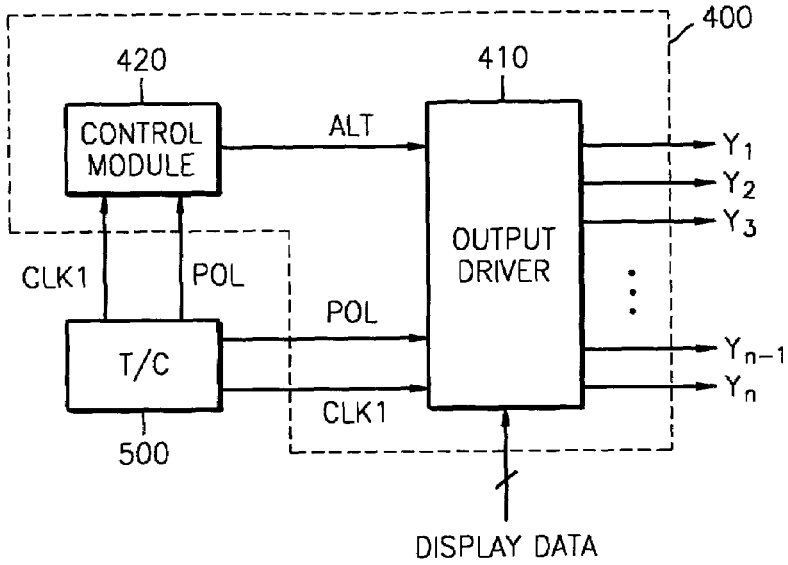
FIG. 4 is a block diagram of a source driver integrated circuit according to an exemplary embodiment of the present invention.

FIG. 4 is a block diagram of a source driver integrated circuit 400 according to an exemplary embodiment of the present invention. Referring to FIG. 4, a source driver integrated circuit 400 may include an output driver 410 and a control module 420. A timing controller 500 may be provided to provide control signals to the output driver 410 and control module 420.

The output driver 410 may generate panel driving voltages Y1 through Yn corresponding to a plurality of display data in response to a clock signal CLK1, polarity control signal POL and a switch control signal ALT. The timing controller 500 generates the clock signal CLK1 used to control the output driver 410 and the polarity control signal POL. The control module 420 outputs the switch control signal ALT in response to both the clock signal CLK1 and the polarity control signal POL received from timing controller 500.

The display data may be embodied as digital data comprised of a plurality of bits, for example. In output driver 410, an output amplifier (not shown in FIG. 4, but described in further detail hereafter) may be provided for each of the panel driving voltages Y1 through Yn. In order to output the n panel driving voltages Y1 through Yn at the same time, n output amplifiers may be employed. One horizontal line of a liquid crystal panel is displayed when the n panel driving voltages Y1 through Yn are generated by the n output amplifiers. Alternatively, It is possible to drive one liquid crystal panel using at least two output drivers 410.

The clock signal CLK1 is a horizontal synchronization signal that is enabled for driving a liquid crystal panel. In other words, the output driver 410 simultaneously outputs the panel driving voltages Y1 through Yn in response to the enabled clock signal CLK1, so that horizontal lines of the liquid crystal panel are displayed one by one in response to the enabled clock signal CLK1.

Figure 5:
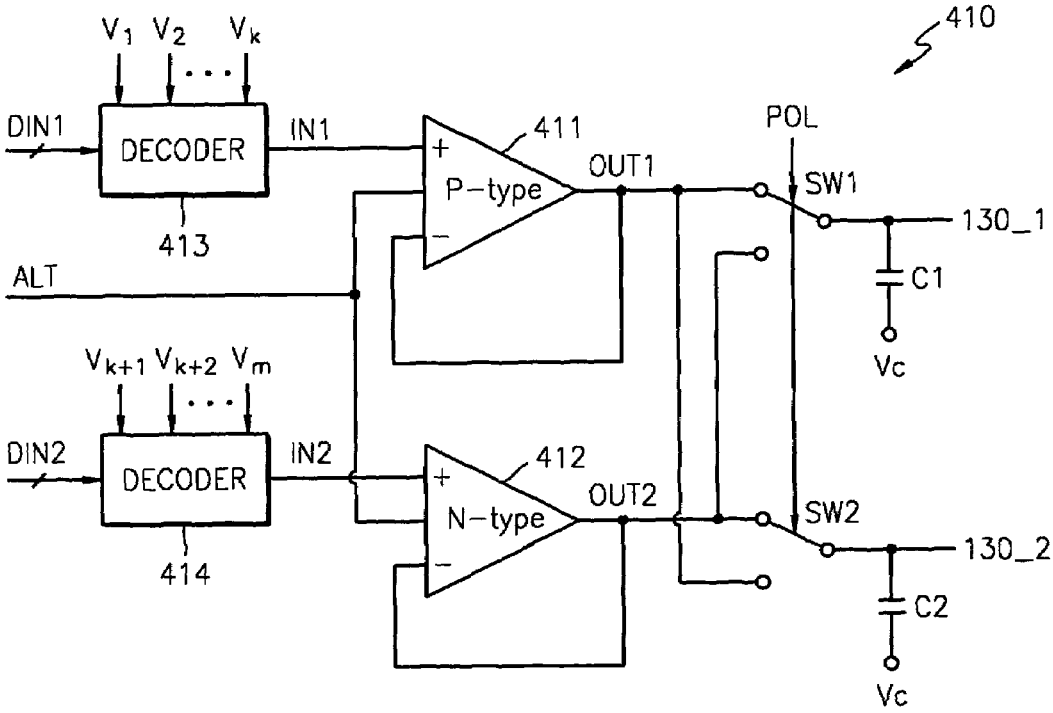
FIG. 5 is a circuit diagram of an output driver shown in FIG. 4.

FIG. 5 is a circuit diagram of the output driver 410 of FIG. 4. Referring to FIG. 5, the output driver 410 includes decoders 413 and 414. Decoder 413 may be embodied as a negative grey scale voltage decoder, for example, and decoder 414 may be a positive grey scale voltage decoder. The positive grey scale voltage decoder 414 receives display data DIN2, selects one voltage IN2 corresponding to the display data DIN2 from a plurality of selectable positive grey scale voltages Vk+1 through Vm, and outputs the selected positive grey scale voltage IN2. The negative grey scale voltage decoder 413 receives display data DIN1, selects one voltage IN1 corresponding to the display data DIN1 from a plurality of selectable negative grey scale voltages V1 through Vk, and outputs the selected negative grey scale voltage IN1. Of the grey scale voltages V1 through Vm, voltages higher than a common voltage (Vc in FIG. 1) may be referred to as positive grey scale voltages, and voltages lower than the common voltages may be referred to as negative grey scale voltages.

The output driver 410 may additionally include an N-type amplifier 412 and a P-type amplifier 411. The P-type amplifier 411 and the N-type amplifier 412 may be configured as voltage followers having one input port, to which a grey scale voltage is input, and another input port connected to an output port.

The N-type amplifier 412 amplifies the grey scale voltage IN2 input from the positive grey scale decoder 414 and outputs the amplified grey scale voltage IN2 as a panel driving voltage OUT2. The P-type amplifier 411 amplifies the grey scale voltage IN1 input from the negative grey scale voltage decoder 413 and outputs the amplified grey scale voltage IN1 as a panel driving voltage OUT1. In FIG. 5, the grey scale voltages IN1 and IN2 are input into positive input ports (+) of the amplifiers 411 and 412, respectively, and negative input ports (−) of the amplifiers 411 and 412 are connected to output ports of the amplifiers 411 and 412, respectively. The input ports of the amplifiers 411 and 412 may be switched in response to the switch control signal ALT, described more fully hereafter.

In FIG. 5, two decoders and two amplifiers are illustrated for purposes of clarity. However, the exemplary embodiments of the present invention are not so limited, as n decoders and n amplifiers may be utilized in order to output the n panel driving voltages Y1 through Yn.

The output driver 410 further includes switches SW1 and SW2. Switched SW1 and SW2 may be used to alternately apply the output OUT1 of the N-type amplifier 411, and output OUT2 of the P-type amplifier 411, respectively, to an even-numbered source line and an odd-numbered source line. For example, if switches connected to a first gate line of a liquid crystal panel are turned on, the output OUT1 of the P-type amplifier 411 is applied to a first ('odd-numbered') source line 130_1, and the output OUT2 of the N-type amplifier 412 is applied to a second ('even-numbered') source line 130_2. On the other hand, if switches connected to a second gate line of the liquid crystal panel are turned on, the output OUT1 of the P-type amplifier 411 is applied to the second source line 130_2, and the output OUT2 of the N-type amplifier 412 is applied to the first source line 130_1. This switching process is controlled by polarity control signal POL. In other words, the P-type amplifier 411 and the N-type amplifier 412 each switch their positive and negative input ports (+) and (−) in response to the switch control signal ALT.

As discussed previously, pixels may be described with reference to one or more frames. The phase of the polarity control signal POL may be inverted on each gate line, i.e., each horizontal line of a liquid crystal panel and in each frame. Thus the polarity control signal POL may be generated so that its phase alternates between a logic high level and a logic low level in each frame. Accordingly, the polarity of voltages applied to adjacent pixels of a liquid crystal panel varies from pixel to pixel, and the phase of voltage applied to each pixel varies from frame to frame.

Figure 6:
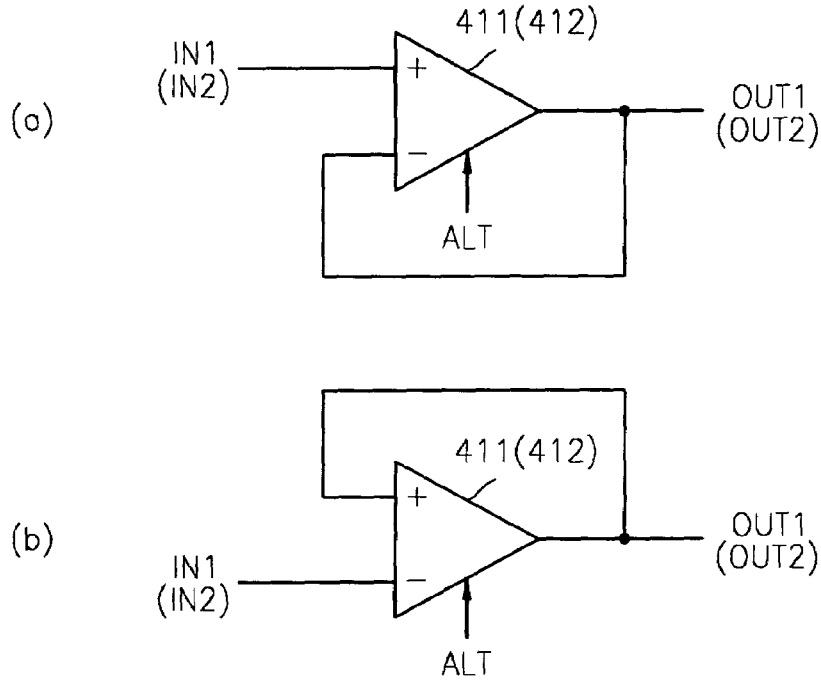
FIG. 6 is a circuit diagram illustrating the switching of input ports of an amplifier in response to a switch control signal in accordance with an exemplary embodiment of the present invention.

FIG. 6 is a diagram illustrating the switching of input ports of an amplifier in response to the switch control signal ALT. As shown in FIG. 6, at (a), the grey scale voltage IN1 (or IN2) is input into the positive input port (+) of the amplifier 411 (or 412), and the negative input port (−) is connected to the output port OUT1 (or OUT2). If a switch control signal ALT is generated, the positive and negative input ports (+) and (−) are switched so that the grey scale voltage IN1 (IN2) is input into the negative input port (−) and the positive input port (+) is connected to the output port OUT1 (OUT2), as shown in FIG. 6 at (b). Then, if another switch control signal is generated, the positive and negative input ports (+) and (−) are again switched, so that the grey scale voltage IN1 (IN2) is input into the positive input port (+) and the negative input port (−) is connected to the output port OUT1 (OUT2). In other words, the positive and negative input ports (+) and (−) of the amplifier 411 (412) are switched in response to the switch control signal ALT.

The switching of the positive and negative input ports (+) and (−) of the amplifier 411 (412) causes the DC offset of the output port OUT1 (OUT2) of the amplifier 411 (412) to switch between a positive value and a negative value. For example, if the grey scale voltage IN1 (or IN2) is input into the positive input port (+), a DC offset of +A is included in the output port OUT1 (OUT2). If the grey scale voltage IN1 (or IN2) is input into the negative input port (−), a DC offset of −A is included in the output OUT1 (OUT2) of the amplifier 411 (or 412).

Accordingly, it is possible to prevent a stripe phenomenon from occurring on an LCD screen by switching the input ports of an amplifier, so that DC offsets generated during the switching process can cancel each other out. In other words, DC offsets can cancel each other out rather than accumulate only when the input ports of an amplifier are switched for every frame of a pixel. If a grey scale voltage is input into only a positive input port or a negative input port of an amplifier without switching the positive and negative input ports, DC offsets accumulate.

Thus, the output driver 410 alternately inverts the polarity of the panel driving voltage applied to each pixel of the liquid crystal panel in each frame. In other words, the input ports (+) and (−) of an output amplifier 411 (or 412) are controlled so that the input ports can be switched on a regular basis, such as on a frame-by-frame basis or every few frames, for example.

According to the exemplary embodiments of the present invention, it is possible to prevent DC offsets from accumulating, irrespective of the number of clock signals generated during a blanking period or the number of gate lines affecting the resolution of a liquid crystal panel. To achieve this, the switch control signal ALT used to switch the input ports of an amplifier in the output driver 410 may be generated by the control module 420.

Figure 7:
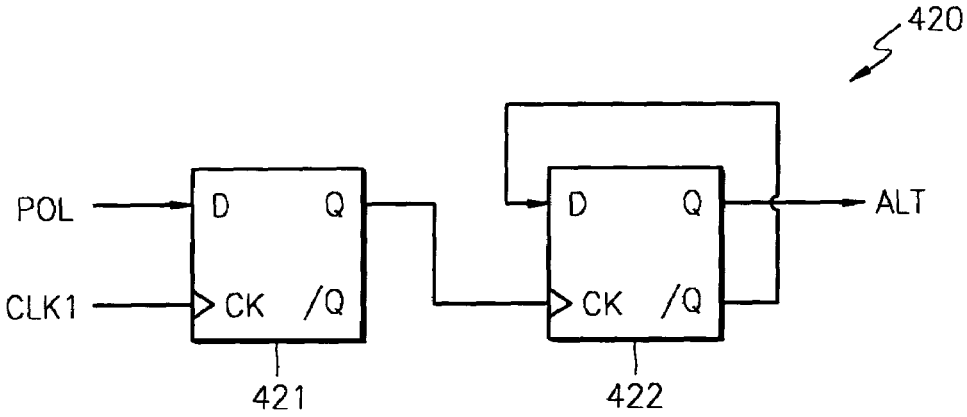
FIG. 7 is a diagram illustrating an exemplary embodiment of a control module shown in FIG. 4.

FIG. 7 is a diagram illustrating an exemplary embodiment of the control module 420 shown in FIG. 4. Referring to FIG. 7, the control module 420 may include first and second flipflops 421 and 422. The polarity control signal POL is input into an input port D of the first flipflop 421, and the clock signal CLK1 is input into a clock port CK of the first flipflop 421. An output signal of the first flipflop 421 is input into a clock port CK of the second flip-flop 422. A signal output from a non-inversion output port Q of the second flip-flop 422 is the switch control signal ALT, and a signal output from an inversion output port/Q is input into an input port D of the second flipflop 422.

In operation of the control module 420, the first flipflop 421 outputs the polarity control signal POL in synchronization with the clock signal CLK1, and more particularly in synchronization with a rising edge of the clock signal CLK1. The second flipflop 422 inverts its output signal, i.e., the switch control signal ALT, in synchronization with the output signal of the first flip-flop 421.

Accordingly, the switch control signal ALT is synchronized with the rising edge of the clock signal CLK1 and has a period twice as long as that of the polarity control signal POL. In other words, the frequency of the switch control signal ALT is half the frequency of the polarity control signal POL.

Figure 8:
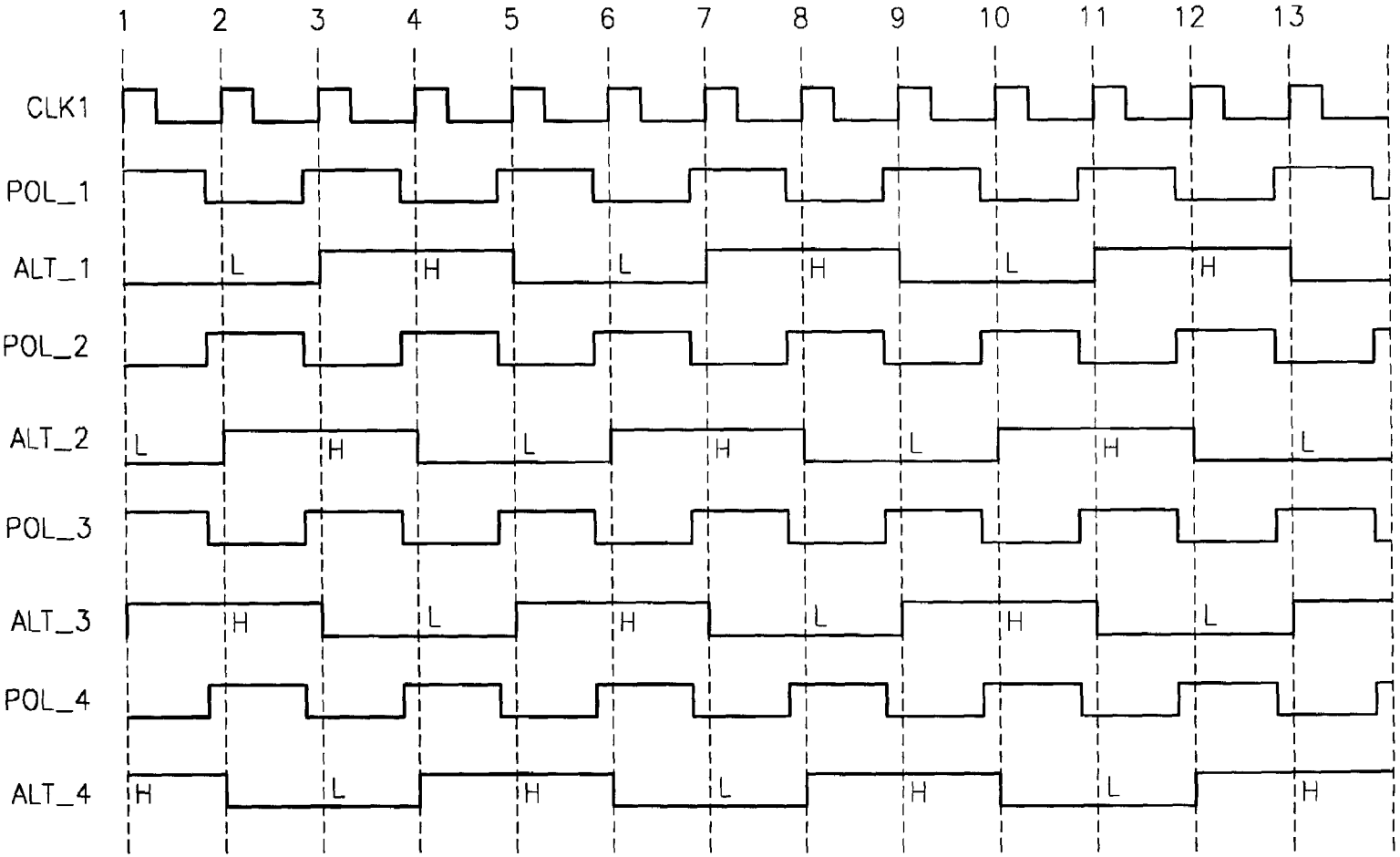
FIG. 8 is a timing diagram showing a clock signal, polarity control signals, and switch control signals in accordance with an exemplary embodiment of the present invention.

FIG. 8 is a timing diagram showing the relationship between the clock signal CLK1, polarity control signal POL, and switch control signal ALT. In FIG. 8, exemplary clock periods of the clock signal CLK1 are shown as dotted vertical lines numbered 1 . . . 13, with the rising edge of the clock signal CLK1 occurring at the beginning of each period. Referring to FIG. 8, the clock signal CLK1 is activated on each horizontal line of a liquid crystal panel so that horizontal synchronization of the liquid crystal panel can be achieved. The phase of the polarity control signal POL alternates between a first logic level H and a second logic level L every period of the clock signal CLK1, so that the polarity of a panel driving voltage changes in each successive horizontal line of the liquid crystal panel.

Assuming that a polarity control signal POL_1 for a first frame is generated, as shown in FIG. 8, a switch control signal ALT_1 for the first frame, which is generated by the control module 420 of FIG. 7, has a phase pattern as shown in FIG. 8. The phase of the switch control signal ALT_1 is inverted in the order of L, L, H, H, L, . . . , in synchronization with each odd-numbered (first, third, fifth, . . . , thirteenth) rising edge of the clock signal CLK1.

A polarity control signal POL_2 for a second frame is an inverted signal of the polarity control signal POL_1 for the first frame. Accordingly, a switch control signal ALT_2 for the second frame inverts its phase in the order of L, H, H, L, L, . . . , in synchronization with each even-numbered (second, fourth, sixth, . . . , twelfth) rising edge of the clock signal CLK1.

A polarity control signal POL_3 for a third frame is an inverted signal of the polarity control signal POL_2 for the second frame. Accordingly, the polarity control signal POL_3 for the third frame is the same as the polarity control signal POL_1 for the first frame. The phase of a switch control signal ALT_3 for the third frame, like the switch control signal ALT_1 for the first frame, is inverted in the order of H, H, L, L, H, . . . , in synchronization with each of the odd-numbered rising edges of the clock signal CLK1.

A polarity control signal POL_4 for a fourth frame is an inverted signal of the polarity control signal POL_3 for the third frame. Accordingly, the polarity control signal POL_4 for the fourth frame is the same as the polarity control signal POL_2 for the second frame. Therefore, the phase of a switch control signal ALT_4 for the fourth frame, like the switch control signal ALT_2 for the second frame, is inverted in the order of H, L, L, H, H, . . . , in synchronization with each of the even-numbered rising edges of the clock signal CLK1.

As shown in FIG. 8, a switch control signal ALT for a given frame may become faster or slower than a switch control signal ALT for a previous frame by one cycle of the clock signal CLK1. In FIG. 8, a switch control signal ALT_i for a predetermined frame becomes faster than a switch control signal ALT_i−1 for a previous frame. In other words, the switch control signal ALT_i−1 is the same as a signal obtained by shifting the switch control signal ALT_i to the left by one cycle of the clock signal CLK1.

FIG. 9 is a table showing various states of a switch control signal of FIG. 8 in different lines. Referring to FIG. 9, a switch control signal ALT for a first line 1 changes its phase in the order of L, L, H, and H over four frames. A switch control signal ALT for a second line 2 changes its phase in the order of L, H, H, and L over four frames. As described above, the switch control signal ALT generated in the control module 420 during four frames reaches a low logic level twice and a high logic level twice. A switch control signal ALT may have different states for two different frames having the same polarity control signal.

For example, the polarity control signals POL_1 and POL_3 for the first and third frames, respectively, are at a logic high level. The switch control signals ALT_1 and ALT_3, however, have a logic low level and a logic high level, respectively. Supposing that a panel driving voltage applied to a pixel has as much a DC offset of +A when the polarity control signal POL is at a logic high level and the switch control signal ALT is at a logic low level, the panel driving voltage has a DC offset of −A when both the polarity control signal and the switch control signal ALT are at a logic high level. Accordingly, DC offsets of the panel driving voltage can cancel each other out.

When the polarity control signals POL_2 and POL_4 for the second frame and the fourth frame, respectively, of the first line 1 of FIG. 9 are at a logic high level, their corresponding switch control signals ALT_2 and ALT_4 have different phases, i.e., a logic low level and a logic high level, as shown in FIG. 9. Supposing that a panel driving voltage applied to a pixel has a DC offset of +B when both the polarity control signal POL and the switch control signal ALT are at a logic low level, the panel driving voltage has a DC offset of −B when the polarity control signal is at a logic low level and the switch control signal ALT is at a logic high level, and accordingly, DC offsets of the panel driving voltage can cancel each other out.

As described above, according to the present invention, a panel driving voltage applied to each pixel of a liquid crystal panel has offsets of +A, −A, +B, and −B over four (4) frames, respectively. Accordingly, DC offsets of a panel driving voltage may cancel one another out every four frames.

According to the exemplary embodiments of the present invention, it is possible to cancel DC offsets out every four frames even when the resolution of a liquid crystal panel or the frequency of occurrence of a clock signal in each frame varies. Accordingly, the stripe phenomenon caused by accumulation of DC offsets can be prevented, and the quality of picture images displayed on a liquid crystal panel may be improved.

While the present invention has been particularly shown and described with reference to exemplary embodiments thereof, it will be understood by those of ordinary skill in the art that various changes in form and details may be made therein without departing from the spirit and scope of the exemplary embodiments of the present invention as defined by the following claims.

What is claimed is:

1. A source driver integrated circuit for driving a thin film transistor liquid crystal display (TFT-LCD), comprising:

an output driver outputting a panel driving voltage to drive pixels of a liquid crystal panel in response to a clock signal and a given polarity control signal, the output driver including:

a decoder selecting and outputting a grey scale voltage corresponding to an input digital signal;

at least two output amplifiers amplifying the grey scale voltage output from the decoder and outputting the result of the amplification, the output amplifiers each having a first input port into which the output signal of the decoder is input and a second input port electrically connected to an output port, the input ports switched in response to a given switch control signal;

at least one switch switching and applying the output voltages of the at least two amplifiers to the liquid crystal panel as the panel driving voltage in direct response to the polarity control signal; and a control module generating the switch control signal in response to the clock signal and the given polarity control signal.

2. The circuit of claim 1, wherein the phase of the polarity control signal is adapted to alternate between a logic high level and a logic low level in each frame of a pixel in the liquid crystal panel.

3. The circuit of claim 2, wherein the panel driving voltage has a positive polarity or a negative polarity, and the output driver alternately inverts the polarity of the panel driving voltage applied to each pixel of the liquid crystal panel in each frame.

4. The circuit of claim 3, wherein the control module includes:

a first flipflop receiving and outputting the polarity control signal in response to the clock signal; and a second flipflop outputting a signal that is input to an input port of the second flipflop as the switch control signal, in response to the polarity control signal output from the first flipflop.

5. The circuit of claim 3, wherein the switch control signal is synchronized with the clock signal, the switch control signal having a period twice the length of the period of the polarity control signal.

6. The source driver integrated circuit of claim 3, wherein DC offsets of the panel driving voltage applied to each pixel of the liquid crystal panel cancel one another out every four frames.

7. A circuit for driving a thin film transistor liquid crystal display (TFT-LCD), comprising:

a decoder selecting and outputting a positive voltage or a negative voltage in response to an input digital signal;

first and second amplifiers amplifying and outputting the positive and negative voltages, respectively, in response to the clock signal, each of the first and second amplifiers having a pair of input ports that are switched in response to a given switch control signal;

at least one switch switching and applying output voltages of the first and second amplifiers to a liquid crystal panel in direct response to a polarity control signal; and a control module generating the switch control signal in response to the clock signal and the polarity control signal.

8. The circuit of claim 7, wherein the positive and negative voltage are grey scale voltages, the first amplifier has one input port receiving the positive voltage and another input port electrically connected to an output port of the first amplifier, and the second amplifier has one input port receiving the negative voltage and another input port electrically connected to an output port of the second amplifier.

9. The circuit of claim 7, wherein the control module includes:

a first flipflop receiving and outputting the polarity control signal in response to the clock signal; and a second flipflop outputting a signal that is input to an input port of the second flipflop as the switch control signal, in response to the polarity control signal output from the first flipflop.

10. The circuit of claim 7, wherein the switch control signal is synchronized with the clock signal, the switch control signal having a period twice the length of the period of the polarity control signal.

11. The circuit of claim 7, wherein each of the output voltages of the first and second amplifiers represent a panel driving voltage to drive pixels of the liquid crystal panel, and DC offsets of the panel driving voltage applied to each pixel of the liquid crystal panel cancel one another out every four frames.

12. A method of eliminating offsets of a thin film transistor liquid crystal display (TFT-LCD) driving voltage in a TFT-LCD having a plurality of amplifiers, each amplifier having first and second input ports and generating a panel driving voltage of a positive or negative polarity corresponding to a input digital signal, the method comprising:

applying a panel driving voltage to a given pixel of a liquid crystal panel in response to a clock signal;

changing the polarity of the applied panel driving voltage in direct response to a polarity control signal;

generating a switch control signal that is synchronized to a clock signal and based on the polarity control signal;

switching the first and second input ports of each of the plurality of amplifiers in response to the switch control signal.

13. The method of claim 12, wherein the switch control signal has a period that is twice the length of the period of the polarity control signal.

14. The method of claim 12, wherein the polarity control signal has substantially the same period as that of the clock signal, and the phase of the polarity control signal is inverted in each frame of the given pixel of the liquid crystal panel.

15. The method of claim 12, wherein said generating includes:

outputting the polarity control signal as a first output signal in response to a first edge of the clock signal; and inverting the switch control signal in response to the first edge of the first output signal.

16. A method of driving voltage in a thin film transistor liquid crystal display (TFT-LCD) having a plurality of amplifiers, each amplifier having first and second input ports, comprising:

applying a panel driving voltage to a given pixel of a liquid crystal panel in response to a clock signal;

changing the polarity of the applied panel driving voltage in direct response to a polarity control signal;

generating a switch control signal based on the polarity control signal; and switching the first and second input ports of each of the plurality of amplifiers based on the switch control signal.

17. The method of claim 16, wherein said switch control signal is synchronized to the clock signal.

18. The method of claim 16, wherein said generating includes:

outputting the polarity control signal as a first output signal in response to a first edge of the clock signal; and inverting the switch control signal in response to the first edge of the first output signal.

19. An apparatus for driving a thin film transistor liquid crystal display (TFT-LCD), comprising:

an output driver outputting a panel driving voltage to drive pixels of a liquid crystal panel in response to an input clock signal and an input polarity control signal, the output driver including, a plurality of amplifiers, each amplifier having first and second input ports and generating a panel driving voltage of a positive or negative polarity corresponding to a input digital signal, and and at least one switch switching and applying the panel driving voltages generated by the plurality of amplifiers to the liquid crystal panel in direct response to the input polarity control signal; and a control module generating a switch control signal in response to the clock signal and the input polarity control signal, the input ports switched in response to the generated switch control signal.

20. The apparatus of claim 19, further comprising a timing controller generating the clock signal and polarity control input to the output driver and control module.

21. The apparatus of claim 19, wherein the phase of the polarity control signal is adapted to alternate between a logic high level and a logic low level in each frame of a pixel in the liquid crystal panel.

22. The apparatus of claim 19, wherein the panel driving voltage has a positive polarity or a negative polarity, and the output driver alternately inverts the polarity of the panel driving voltage applied to each pixel of the liquid crystal panel in each frame.

23. The apparatus of claim 19, wherein the switch control signal is synchronized with the clock signal, the switch control signal having a period twice the length of the period of the polarity control signal.

24. The apparatus of claim 19, wherein DC offsets of the panel driving voltage applied to each pixel of the liquid crystal panel cancel one another out every four frames.

25. A source driver integrated circuit for driving a thin film transistor liquid crystal display (TFT-LCD), adapted to eliminate offsets of a driving voltage in the TFT-LCD in accordance with the method of claim 12.

26. A circuit for driving a thin film transistor liquid crystal display (TFT-LCD) adapted to eliminate offsets of a driving voltage in the TFT-LCD in accordance with the method of claim 12.

27. An apparatus for driving a thin film transistor liquid crystal display (TFT-LCD) adapted to eliminate offsets of a driving voltage in the TFT-LCD in accordance with the method of claim 12.

28. A source driver integrated circuit for driving a thin film transistor liquid crystal display (TFT-LCD), which is adapted to drive the TFT-LCD in accordance with the method of claim 16.

29. A circuit for driving a thin film transistor liquid crystal display (TFT-LCD), which is adapted to drive the TFT-LCD in accordance with the method of claim 16.

30. An apparatus for driving a thin film transistor liquid crystal display (TFT-LCD), which is adapted to drive the TFT-LCD in accordance with the method of claim 16.

* * * * *